US010012463B2

(12) United States Patent
Warnke et al.

(10) Patent No.: US 10,012,463 B2
(45) Date of Patent: Jul. 3, 2018

(54) FIREARM MAGAZINE RELEASE ASSIST DEVICE

(71) Applicants: John Richard Warnke, Westerville, OH (US); Samer Alkhalaileh, Dublin, OH (US)

(72) Inventors: John Richard Warnke, Westerville, OH (US); Samer Alkhalaileh, Dublin, OH (US)

( * ) Notice: Subject to any disclaimer, the term of this patent is extended or adjusted under 35 U.S.C. 154(b) by 0 days.

(21) Appl. No.: 15/206,487

(22) Filed: Jul. 11, 2016

(65) Prior Publication Data

US 2017/0097200 A1 Apr. 6, 2017

Related U.S. Application Data

(63) Continuation-in-part of application No. 14/625,101, filed on Feb. 18, 2015, now Pat. No. 9,429,377.

(60) Provisional application No. 61/941,028, filed on Feb. 18, 2014.

(51) Int. Cl.

| | |
|---|---|
| ***F41A 9/61*** | (2006.01) |
| ***F41A 9/59*** | (2006.01) |
| ***F41A 9/64*** | (2006.01) |

(52) U.S. Cl.
CPC . *F41A 9/59* (2013.01); *F41A 9/64* (2013.01)

(58) Field of Classification Search
USPC ..... 42/6, 49.01, 50, 49.1
See application file for complete search history.

(56) References Cited

U.S. PATENT DOCUMENTS

| | | | | |
|---|---|---|---|---|
| 4,664,015 A * | 5/1987 | Kennedy | ..... | F41A 9/59 89/138 |
| 5,353,537 A | 10/1994 | Mercenier | | |
| 7,373,751 B1 | 5/2008 | Schaffer | | |
| 2015/0033608 A1* | 2/2015 | Power | ..... | F41A 9/59 42/6 |

* cited by examiner

*Primary Examiner* — J. Woodrow Eldred
(74) *Attorney, Agent, or Firm* — Taylor Intellectual PLLC; James W. Taylor, II

(57) ABSTRACT

A firearm magazine assisted release device is provided. The release device comprises a spring secured with or integrated into a firearm. The spring is biased when a magazine is locked into a firearm, such that when the magazine release button is pressed stored potential energy is released as expansive kinetic energy, ejecting the magazine from the firearm.

18 Claims, 12 Drawing Sheets

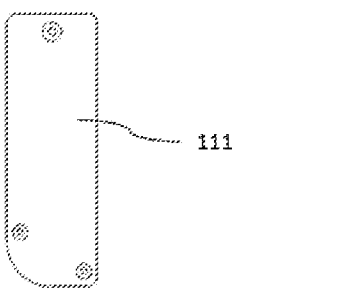
Fig. 1c
Fig. 1d
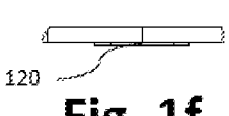
Fig. 1f
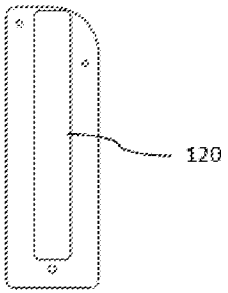
Fig. 1e
Fig. 1g
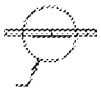
Fig. 1h
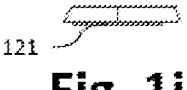
Fig. 1j
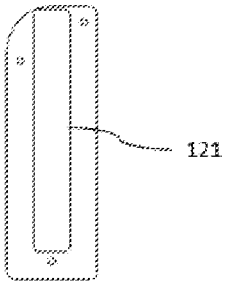
Fig. 1i
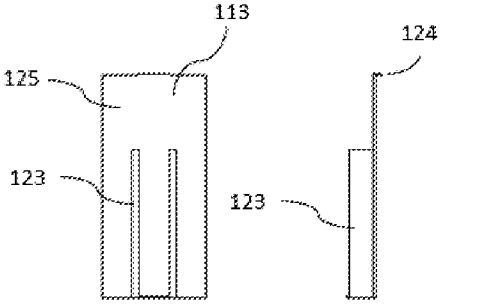
Fig. 1k
Fig. 1n
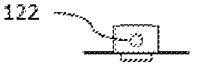
Fig. 1l
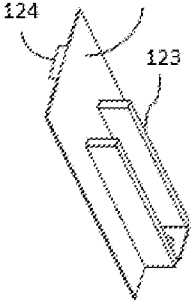
Fig. 1o
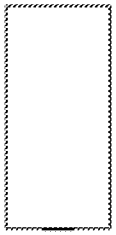
Fig. 1m

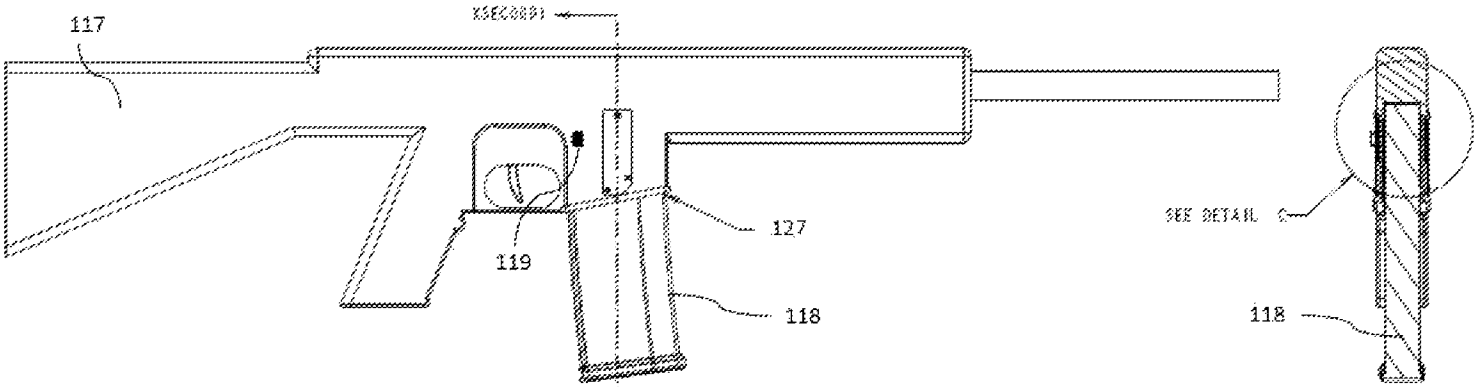
Fig. 1u
Fig. 1t
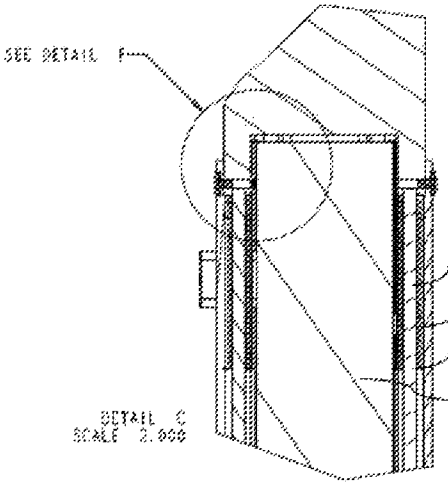
Fig. 1v
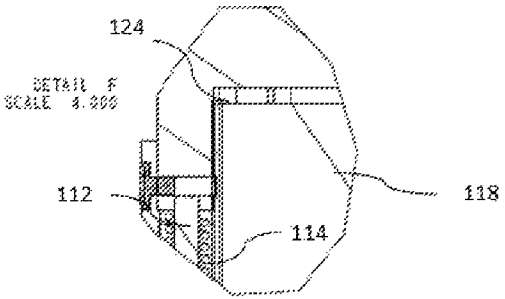
Fig. 1w

FIREARM MAGAZINE RELEASE ASSIST DEVICE

This application claims priority under 35 U.S.C. 120 based upon Non-Provisional application Ser. No. 14/625,101 entitled FIREARM MAGAZINE RELEASE ASSIST DEVICE, filed Feb. 18, 2015, which in turn claims priority under 35 U.S.C. 119(e) based upon Provisional Application Ser. No. 61/941,028 entitled FIREARM MAGAZINE RELEASE ASSIST DEVICE, filed Feb. 18, 2014, which is incorporated herein by reference in its entirety.

FIELD OF THE INVENTION

The disclosure as set forth herein is a firearm magazine release assist device that helps a firearm operator to remove a magazine from a firearm quickly and without any additional physical effort from the user.

BACKGROUND OF THE INVENTION

Many firearms utilize magazines to hold ammunition. Such firearms include most semi-automatic firearms, which fire a single round when the trigger is pulled but automatically cycle through all necessary steps to prepare another round to be fired, and fully-automatic firearms, which fire a plurality of rounds when the trigger is pulled or held. Examples of such firearms are carbines, many pistols, and semiautomatic shotguns. Once the firearm exhausts its rounds from the magazine, it is necessary to remove the spent magazine and replace it with a loaded one to continue discharging the firearm. Generally, removing a spent magazine requires that the firearm operator depresses a magazine release button. The magazine then falls out of the chamber by its own weight.

Firearm users, especially military and law enforcement, are sometimes faced with situations requiring them to quickly replace the firearm's magazine. Such situations may reasonably endanger the user's life. Therefore, it is important that magazine stripping is reliable and does not become a hindrance. Even a small delay, such as fractions of a second, in unloading of a spent or malfunctioning magazine and re-loading a full magazine could have grave results on the firearm operator.

Competition shooters, such as those involved in high speed shooting and magazine reloading, are often rate-limited by a spent magazine that does not release from the firearm. Their entire performance is bottlenecked by a mechanical process with little to do with the sport itself. In order to avoid such a situation, many such shooters release the magazine while it still contains some rounds because a partially full magazine is heavier than an empty magazine. As such, the magazine drops easier from the firearm than a lighter empty magazine. However, this comes at a cost: the user cannot fire the maximum number of rounds in each magazine.

Many firearm users have developed techniques and skills to allow them to quickly strip a spent magazine out of the firearm after the magazine release button is depressed. These techniques include a sweeping motion with the free hand. Such a motion applies a quick push on the magazine, allowing it to be quickly stripped out of the firearm. This sweeping hand motion is a skill that can only be acquired through dedicated training. Another technique utilizes a quick twist of the firearm to impart centrifugal force to the magazine that is enough to make it slide out of the magazine well by the magazine's own inertia. Yet another technique more commonly associated with pistols involves rapid shaking of the firearm, which helps overcome minor friction and may impart some centrifugal force to assist the magazine falling out of the well. Each technique uses valuable time that in which the user is not firing, while possibly taking fire.

Further, even if these skills are mastered, a user could potentially mistake the motions, resulting in a failure to strip the magazine from the firearm quickly. Therefore, these skills are not reliable and have inherent risk. Yet the skills might not be necessary if magazine stripping becomes automatic, which would eliminate the need to develop special skills or techniques and ultimately would be expected to decrease the probability of failure.

Yet even further, firearm operators in dusty or sandy environments are faced with the challenge of dust or dirt getting into their firearms, especially onto the magazine or inside the magazine well. Presence of dust or dirt on the surface of the magazine may significantly increase the friction between the magazine body and the inside wall of the magazine well. This condition slows down the release of the magazine and the specialized skills discussed above may not be sufficient to release the magazine quickly. In extreme cases, the magazine may even hang inside the magazine well. Such a condition requires that the firearm operator uses his/her free hand to pull the magazine out of the firearm. Again, such a situation could have serious ramifications, including additional rounds being fired at the user before the user can neutralize his intended target, which increases the probability of being hit, endangering any missions and the user himself.

Continuous use of a firearm and its magazines will result in the increased temperature of both firearm and magazines. In some cases the magazines expand (swell) and become tightly wedged inside the magazine well. Ultimately this will increase the friction of the magazine against the firearm's magazine well, slowing or even stopping the magazine from falling out of the firearm without external influence.

In all of the above situations, removal of a spent magazine requires that the firearm operator pulls the magazine using the free hand which is a distraction and an extra effort that may literally endanger the firearm user's life. The net result is a decreased chance of a successful engagement.

Mercenier (U.S. Pat. No. 5,353,537) uses a technique wherein an ejection thread spring is added to each magazine, but is exclusively mounted at the bottom of the magazine or on the magazine plate of the magazine (col. 2, lines 54-63). However, this technique has several disadvantages. First, it only applies force from one edge of the magazine, which can apply appreciable torque, even resulting in a jam. Second, it will not function for any magazine wherein the magazine is not completely inserted into the magazine well during use such that the bottom of the magazine is flush with the bottom of the well. Third, the spring is partially inside the magazine, so it cannot be merely moved halfway up the magazine without severely limiting the number of rounds the magazine can hold as ammunition will not be able to be fed past the spring on the inside of the magazine, so the spring will effectively redefine the bottom of the magazine, only housing an empty cavity below itself.

Therefore, there is a need for a mechanism to assist in stripping a magazine from a firearm that is robust and adaptable to a plurality of firearms and magazines. Further, backward compatibility with firearms that have already been manufactured is highly desirable.

SUMMARY OF THE INVENTION

The present inventors have found that by biasing the magazine by the potential energy of a coiled spring or other potential energy storing device, the spring can be ejected under greater force than just the weight of the magazine.

In a first embodiment of the invention, a magazine release assist assembly for a magazine-loading firearm is provided, comprising: a spring assembly comprising at least one spring, wherein the magazine release assist assembly additionally comprises a mechanism to secure the spring assembly to the firearm, or the spring assembly is integrated with or otherwise part of the firearm; wherein when the spring assembly is installed into a firearm such that when a magazine is loaded into the firearm's magazine well, the at least one spring biases storing potential energy; and wherein the stored potential energy can be released as kinetic energy to assist in removing the magazine from the firearm. Additionally, the magazine release assist assembly may: use a plurality of springs, such as a pair of springs that may be on opposite sides of the assembly, be parallel, and be aligned such that when they are biased they always bias in the same direction, or such as being at regular intervals around the spring assembly to prevent torqueing of the magazine and sticking of the magazine when releasing the magazine; use a helical spring as one of the springs; use a flat spring as one of the springs; and when the magazine is ejected from the firearm, the spring assembly may remain secured to the firearm.

In another embodiment of the invention, a method of releasing a magazine from a firearm is provided, comprising: securing a spring assembly comprising at least one spring to a firearm such that when a magazine is inserted into the firearm, the at least one spring is biased to store potential energy; and ejecting the magazine from the firearm wherein the spring converts the stored potential energy into kinetic energy that assists the ejection. Further, this embodiment may: use a plurality of springs, such as a pair of springs at regular intervals around the spring assembly to prevent torqueing of the magazine and sticking of the magazine when releasing the magazine or a pair of springs on opposite sides of the assembly, which are parallel, and are aligned such that when they are biased, they are always biased in the same direction. The at least one spring may be inter alia a helical spring or a flat spring.

In another embodiment of the invention, a method of manufacturing a spring assembly to assist ejecting a magazine from a firearm is provided, comprising: machining a spring assembly comprising at least one spring, machining a mechanism to secure the spring assembly to or integrate the spring assembly with the firearm; and securing the spring assembly with the mechanism to secure the spring assembly to or integrate the spring assembly with the firearm. Additionally this embodiment may have the feature that mechanism to secure the spring assembly to or integrate the spring assembly with the firearm is adapted to surround the base of the firearm's magazine well and tighten, such that the mechanism to secure the spring assembly to or integrate the spring assembly with the firearm surrounds and is secured to the base of the firearm's magazine well.

In another embodiment of the invention, a spring assembly to assist releasing a magazine from a firearm is provided, comprising: a rectangular body, wherein the rectangular body comprises two parallel flat springs; wherein the rectangular body is adapted to be secured to the base of a magazine well of a firearm; wherein one end of each of the two flat springs is secured to the rectangular body, and the other end of each of the two flat springs is not secured to the rectangular body; and wherein the spring assembly is designed such that when the spring assembly is installed on a firearm, the end of each of the two flat springs that is not secured to the rectangular body is adapted to slide against the edge of the firearm's magazine well such that it is backed and cannot bend further than the edge of the magazine well. In this embodiment, the two flat springs may be on substantially opposite sides of the rectangular body and face substantially the same direction.

In another embodiment of the invention, a spring assembly to assist releasing a magazine from an integrated firearm is provided, comprising: a firearm comprising a magazine well; two rods integrated with the firearm, installed parallel to the direction magazines are inserted and removed to the magazine well; one sliding member installed on each of the two rods, such that the sliding members can slide up and down the rods; and one helical spring installed on each of the two rods, such that the springs extend push the sliding members to one side of the rods but can be compressed so the sliding members travel down the rod; wherein when a magazine is loaded into the firearm, the magazine catches the sliding members, slide the sliding members up the two rods, and compress the helical springs, such that when the magazine is fully loaded and locked into the firearm, the helical springs are compressed; and wherein when the magazine is ejected from the firearm, the compressed helical springs release stored energy and assist the magazine in ejection.

BRIEF DESCRIPTION OF THE DRAWINGS

FIG. 1*c* illustrates a front view of a component of the first embodiment "Right had side cover" of the invention.

FIG. 1*d* illustrates a top view of the "Right had side cover" of the invention.

FIG. 1*e* illustrates a back view of the "Right had side cover" of the invention.

FIG. 1*f* illustrates a detailed view of a portion of the side view of the "Right had side cover" of the invention.

FIG. 1*g* illustrates a front view of a component of the first embodiment "Left had side cover" of the invention.

FIG. 1*h* illustrates a top view of the "Left had side cover" of the invention.

FIG. 1*i* illustrates a back view of the "Left had side cover" of the invention.

FIG. 1*j* illustrates a detailed view of a portion of the side view of the "Left had side cover" of the invention.

FIG. 1*k* illustrates a front view of a component of the first embodiment "S shaped hook" of the invention.

FIG. 1*l* illustrates a top view of the "S shaped hook" of the invention.

FIG. 1*m* illustrates a back view of the "S shaped hook" of the invention.

FIG. 1*n* illustrates a side view of the "S shaped hook" of the invention.

FIG. 1*o* illustrates a top perspective view of the "S shaped hook" of the invention.

FIG. 1*t* illustrates a right hand side view of a rifle retrofitted with the first embodiment of the invention, with the magazine fully seated in the rifle.

FIG. 1*u* illustrates a right hand side cross sectional view of a rifle retrofitted with the first embodiment of the invention FIG. 1*t*.

FIG. 1*v* illustrates a detailed view of a portion of the right hand side cross sectional view of a rifle retrofitted with the first embodiment of the invention FIG. 1*u*

FIG. 1*w* illustrates a detailed view of a portion of view in FIG. 1*z*.

FIG. 1*aa* illustrates a detailed view of a portion of view in FIG. 1*z*.

DETAILED DESCRIPTION

Figure 1A:
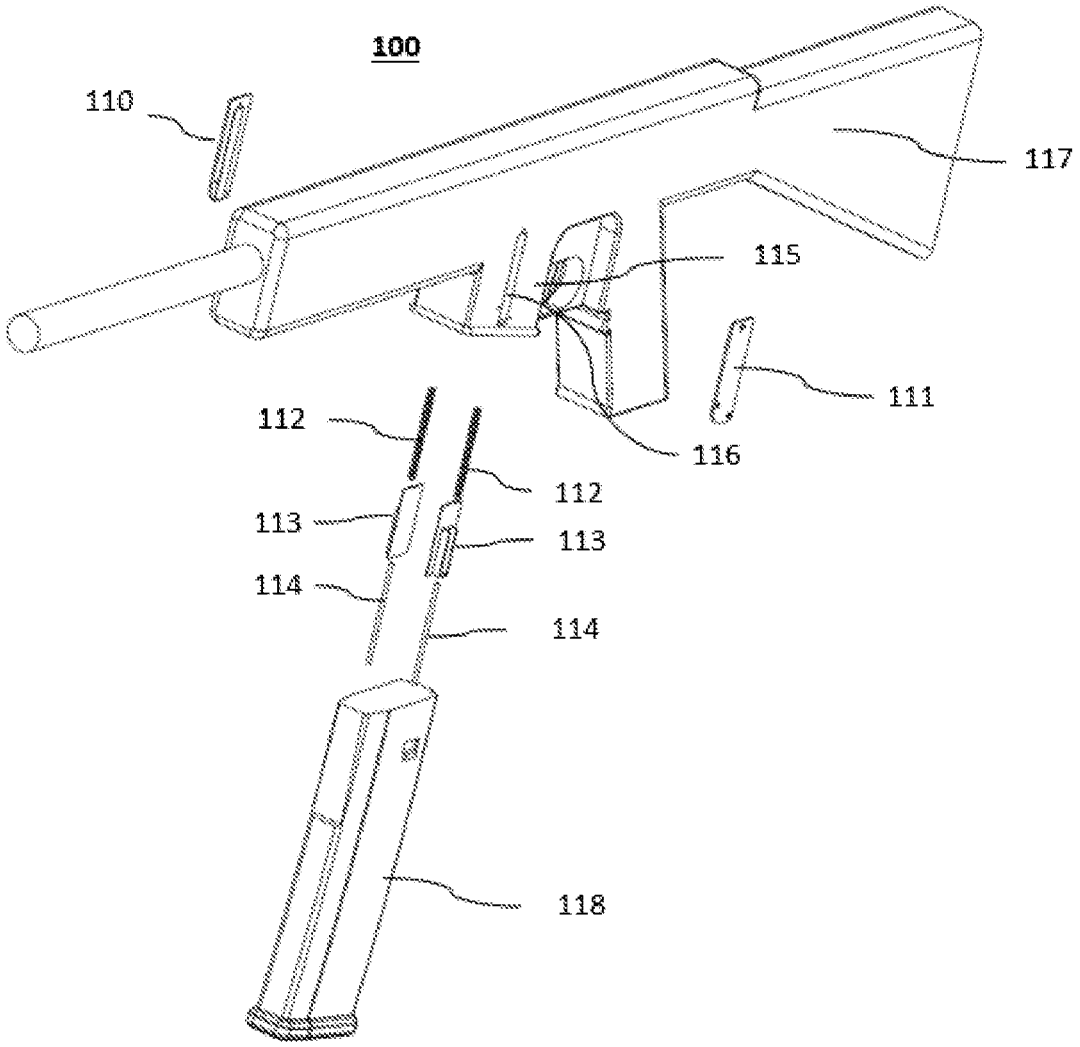
FIG. 1*a* illustrates a perspective exploded view of the first embodiment of the invention.

For the purpose of promoting an understanding of the principles of the claimed technology and presenting its currently understood best mode of operation, reference will be now made to the embodiments illustrated in the drawings and specific language will be used to describe the same. It will nevertheless be understood that no limitation of the scope of the claimed technology is thereby intended, with such alterations and further modifications in the illustrated device and such further applications of the principles of the claimed technology as illustrated therein being contemplated as would typically occur to one skilled in the art to which the claimed technology relates. The present invention is defined by the claims and the claims alone.

Terminology

Some terms used herein will now be defined for the purposes of understanding their scope and breadth in the present invention.

Long guns are to be understood to be guns that have barrels longer than a foot; any and all rifles, shotguns, and submachine guns that utilize magazines; and any firearm that is designed to be used by one individual and fired while the firearm is supported from the shoulder, using a stock. Examples of rifles are AR-15 style firearms and AK-47 style firearms.

Submachine guns ("SMG" or "SMGs") which may also be referred to as "machine carbines" or "machine pistols," are usually lightweight automatic or semi-automatic guns that shoot pistol ammunition with a high rate of fire. SMGs are usually fired from the shoulder or hip, and often have the capacity for shooting single rounds. SMG examples are the Thompson submachine gun and the Heckler & Koch MPS.

Magazine Release Assist

The novel magazine release assist ("MRA") devices are exemplified for inter alia rifles, but the skilled artisan could readily adapt the present invention for any firearm with a magazine in view of the following disclosure and embodiments.

In a broad aspect of the invention, a spring is connected to a rifle body either by modifying the rifle body to anchor a spring or other type of energy storage and conversion device to or into the modified rifle, or anchor the aforementioned device to the rifle externally directly the rifle body or indirectly by first attaching a device to the body of the firearm and attaching the said spring to the attached device. The spring is anchored such that when the magazine is inserted into the firearm, the spring will compress against a part of the magazine or an attachment secured to the magazine, thereby storing potential energy. When the firearm's magazine release button is pressed, the spring will expand, converting potential energy into kinetic energy, giving the magazine momentum to eject from the firearm's magazine well. Further, the present invention will solve the issues discussed above in the background of the invention.

The present invention is robust and can be altered, reengineered, redesigned, and slightly changed without departing from the spirit of the present invention. Of particular importance, note that the parent patent application attaches the spring to the magazine instead of to the firearm body, which is within the disclosure but is only within the scope of the patent application pursuant to the claims below. While the examples below demonstrate custom aftermarket kits that are attached to the rifle, the present invention's scope covers embodiments where the spring is attached directly to external parts of the rifle or is anchored to a device that is formed as part of the rifle or magazine.

Spring

Example 1 discloses a magazine release assistance mechanism that utilizes helical springs, which can have extreme expansive force. Example 2 utilizes a flat spring, which is external anchored to the exterior if the firearm. Flat springs generally have less potential energy storage capacity, but if the open end of the flat spring (the end of the flat spring not connected to the assembly) has support against a structure it can slide against, then the spring constant will generally become reasonable and sufficient for the intended purpose. Alternatively a flat spring can be used with two closed ends, which may have a sufficient spring constant. In the event one end of a flat spring is open, the spring should be designed such that it does not catch and interfere with the magazine's ability to eject itself from the firearm well.

Any material can be used for the present springs that is generally used for that purpose, such as metals, ceramics, ferrous metals, carbon steel, steel alloys, stainless steel, copper, exotic alloys, non-ferrous alloys, plastic, composite, thermoset, rubber, latex, or any other material that can be molded, bent, stamped, laser-cut, otherwise cut, machined, or otherwise formed into the shape of the springs. When selecting a material, several considerations are relevant, such as weight, toughness, impact resistance, failure rate, tendency to crack, ability to hold shape under load, spring characteristics, and coefficient of friction.

It is within ordinary skill of the art to select the force at which the magazine will be pushed out of the firearm by selecting the spring constant values for the springs being used as part of the inventive MRA to store potential energy and ultimately eject the firearm's magazine. It is critical that the spring constant be high enough such that a particular spring can actually store enough energy to effectively assist in the release of the magazine but low enough to be readily deformable (i.e., easy to insert the magazine). As would be understood by the skilled artisan, spring recoil energy and recoil distance depends on several factors. In particular, the spring's material thickness, spring geometry, heat treatment, annealing, the method used to manufacture the spring, Young's modulus, and other spring material properties affect the spring constant. Further the resulting spring must not permanently deform readily, must not easily corrode, self-react, or react with water or oxygen, and must not be brittle. In general, flat springs are preferable, as they provide a simpler and cheaper solution that leads to a more compact and streamlined product while being within the specification as above described. However, any spring is within the scope of the present invention, so long as it can generally accomplish the above purposes. Generally, a metal or alloy, such as stainless steel 316, will have the best physical properties for any spring assemblies.

While it is most convenient for the spring to compress against the edge of the magazine, or against a shelf or shelves anchored to the magazine, it is to be understood that the skilled artisan could trivially design a spring assembly that compressed against another piece of the magazine.

Overall the location of the spring is not particularly important. The spring may be part of the magazine, such part of an assembly that circumferentially surrounds the magazine. Importantly, the spring must be capable of storing potential energy when a magazine is inserted into the firearm and converting that stored potential energy into kinetic energy when ejecting a magazine, thereby assisting in releasing the magazine.

The spring may be part of an assembly that connects to a firearm's magazine well externally or have a slot machined within the magazine well wall itself. Alternatively, the spring may be connected to a different mechanism that in turn connects to the firearm's magazine well or be anchored into a slot machined into the magazine well. Preferably, the spring is a flat spring assembly that is machined by either stamping and bending or laser-cutting and bending a piece of sheet metal or alloy that clips around the magazine well shelf. However, in some embodiments a custom device may be manufactured that attaches to the external surface of the magazine well to which the flat spring is anchored.

Example 1

Figure 1B:
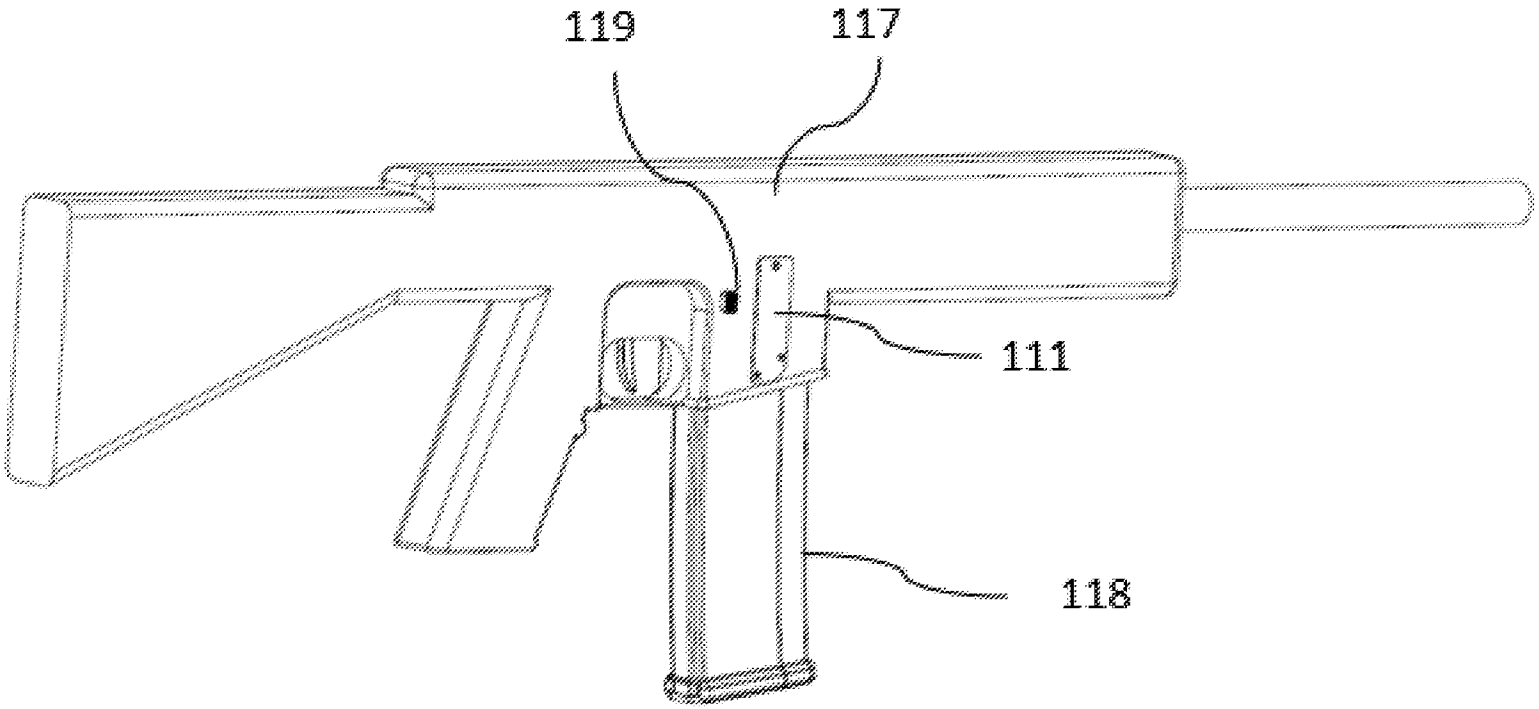
FIG. 1*b* illustrates a perspective right side view of the first embodiment of the invention.
Figure 1P:
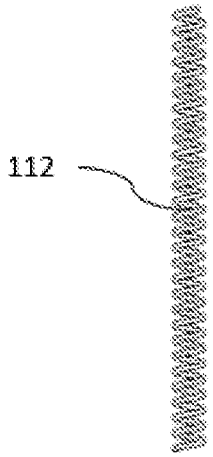
FIG. 1*p* illustrates a front view of a component of the first embodiment "Helical spring" of the invention.
Figure 1Q:
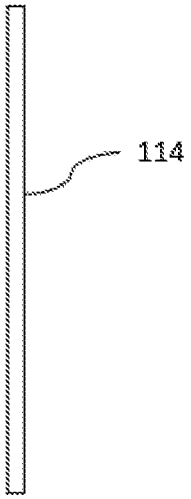
FIG. 1*q* illustrates a front view of a component of the first embodiment "Guide rod" of the invention.
Figure 1R:
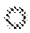
FIG. 1*r* illustrates a top view of a component of the first embodiment "Guide rod" of the invention.

Referring to FIGS. 1*a* and 1*b*, there are four pairs of different components that modify a firearm to make up the first example:

helical springs 112;
sliding structures 113;
posts 114; and
left and right covers 110 and 111.

Covers 110 and 111 are not particular critical and are therefore optional, but they do serve the purpose of protecting moving components of the firearm modification, which helps to prevent interference or contamination that may "gum up" the mechanism, thereby preventing the device from sticking.

Referring to 1*q* and 1*r*, two identical posts 114 are shown in greater detail. Each post 114 penetrates through round openings 129 and 130 in the top and bottom of slot 116 (see FIG. 1*s*). Opening 130 partially penetrates the top part of the wall of the magazine well, whereas opening 129 completely penetrates the base 115 of the magazine well. Mounting the posts between these two opening is critical as the posts act as guides for helical springs 112 and for sliding structures 113.

Referring to 1*k*-1*o*, guiding structures 113 are shown in greater detail. Sliding structures 113 have opening 122 machined into a shelf on it. Opening 112 interacts with post 114 such that the sliding structure 113 can slide up and down the post, but its range of motion is limited within slot 116. The bottom wall of sliding structure 113 collides with the bottom of slot 116, limiting is downward (i.e., expansive) motion. The side walls 123 of sliding structure 113 engages the side walls of slot 116, such that there is no substantial wiggle, torque, or lateral movement. And the top of side walls 123 collide with the top of slot 116 at full compression to limit the upward (i.e., compressive) motion.

Figure 1S:
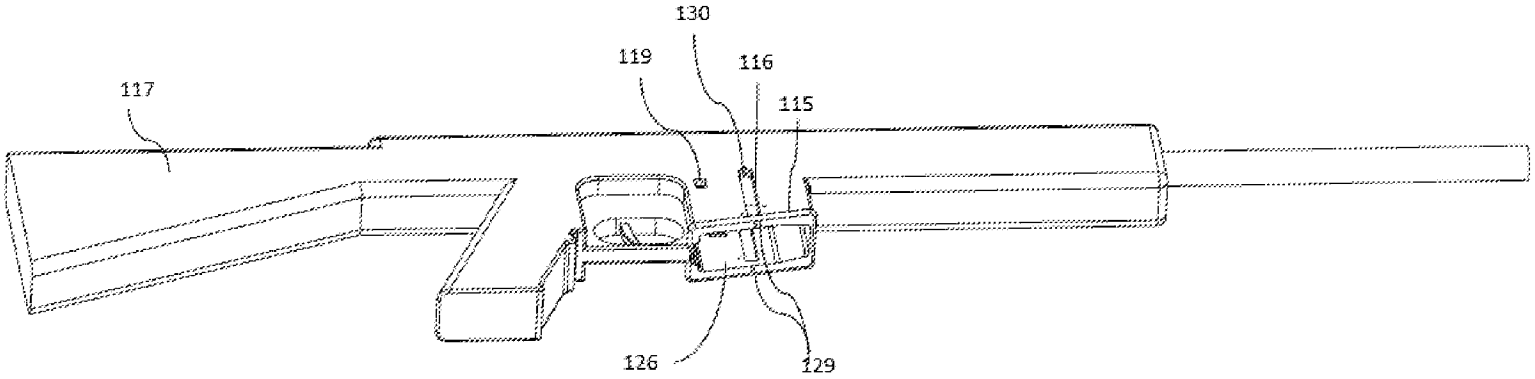
FIG. 1*s* illustrates a bottom perspective view of a rifle modified to be retrofitted with the first embodiment of the invention.
Figure 1Y:
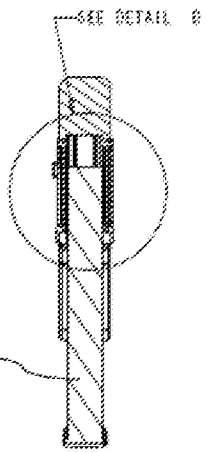
FIG. 1*y* illustrates a right hand side cross sectional view of a rifle retrofitted with the first embodiment of the invention FIG. 1*x*.
Figure 1Z:
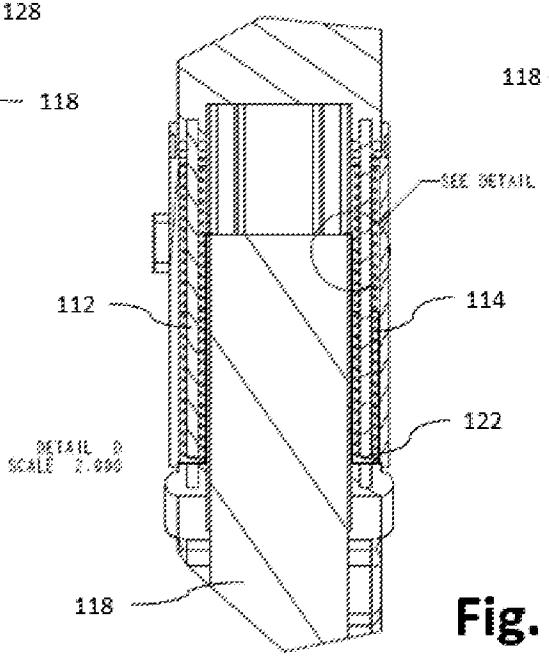
FIG. 1*z* illustrates a detailed view of a portion of the right hand side cross sectional view of a rifle retrofitted with the first embodiment of the invention FIG. 1*y*.
Figure 1X:
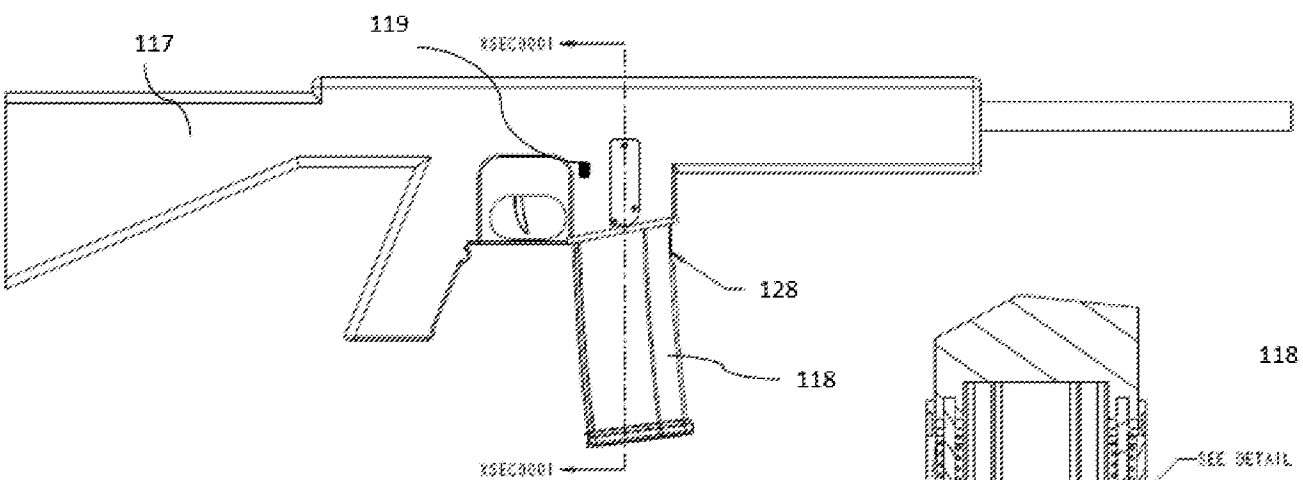
FIG. 1*x* illustrates a right hand side view of a rifle retrofitted with the first embodiment of the invention, with the magazine ejected out of the rifle.
Figure 1A:
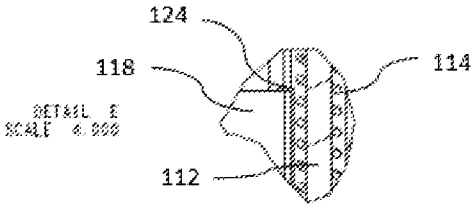

Helical springs 112 are disposed between the opening 122 and the top of the slot 116. Hook 124 catches on the top edge of magazines 118 (FIG. 1*a*) inserted into well 126 (FIG. 1*s*). As the magazines are inserted, hook 124 will slide the entire sliding structure up, thereby compressing helical springs 112 and storing potential energy. When the magazine finally comes to rest into the rifle in the magazine load position, it is locked into place with a biased lock that keeps the magazine 118 held in the magazine load position inside the rifle 117 (see FIGS. 1*b* and 1*t*-1*z* for the assembly in the locked, fully compressed position).

Sliding structures 113 also has a back surface 125 which upon assembly of the MRA component will make contact with the inside wall of the magazine well 126 (FIG. 1*s*). This contact between the back surface 125 of sliding structure 113 and the inside wall of the magazine well 126, will further stabilize sliding structure 113 while moving up into the rifle and down to push the magazine out of the rifle.

As is shown in greater detail in FIGS. 1*c*-1*j*, left and right covers 110 and 111 are shown in great detail. The covers 110 and 111 are designed to be bolted onto the firearm and hide the inner mechanical workings of the MRA. Both covers have a raised face that fits into the slots 116 (see FIGS. 1*a* and 1*b*), the slots 116 are cut on each side of the magazine well 115. The present left and right covers are exemplified with three bolts, but any art standard attaching means can be used to secure the covers 110 and 111 to the firearm, such as screws, glue, pivoting-catching members, etc. In the event of bolts, any reasonable number of bolts can be used.

Covers 110 and 111 each have a back surface, which faces the inside of the firearm and each has a raised surface 120 and 121 for the right and the left hand side respectively. The raised surfaces 120 and 121 on covers 110 and 111 respectively penetrate the slots 116 and make contact with surface of walls 123 on the sliding structures 113. These raised surfaces act as supports for the sliding structures 113, giving stability to the latter during movement or when holding potential energy.

Referring to FIGS. 1*v*-1*z*, the magazine is locked in the load position by the biased magazine release button 119. In order to release the magazine, the magazine release button 119 is pressed. Once pressed, the magazine 118 is no longer locked in position and can travel freely. Potential energy stored by compressed helical spring 112 is converted to kinetic energy by spring expansion, thereby pushing sliding structure 113 down. As sliding members 113 have a hook 124 that catching the magazine, sliding members 113 will push the magazine out of the magazine well 126 as the spring expands.

This first example requires machining or casting or molding the body of the firearm with two slots 116 at either of the opposing sides of the magazine well 126. Some firearm owners may find machining their own firearm undesirable.

Example 2

This example neither requires permanent modification of the firearm, nor requires any specialty considerations during manufacture. As such, this technique is ideal for adaption by existing firearms.

Figure 2A:
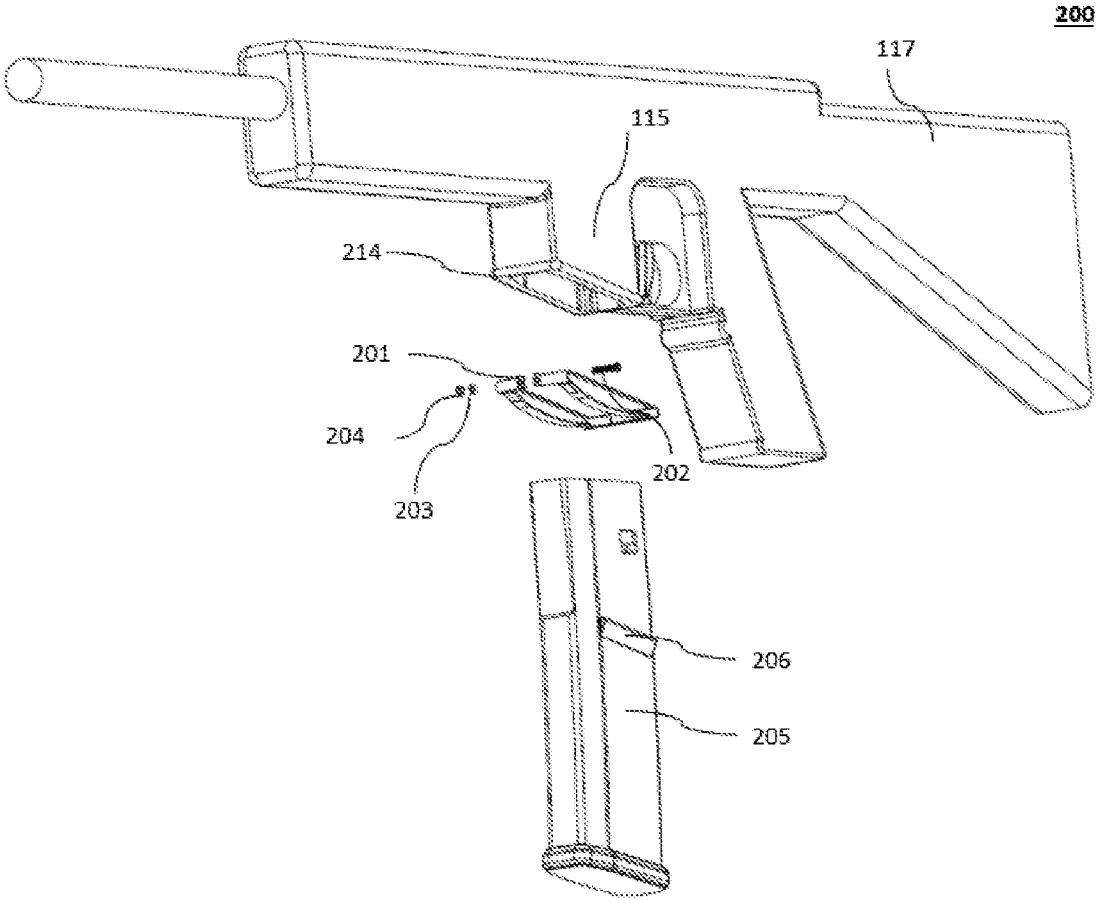
FIG. 2*a* illustrates a perspective exploded view of the second embodiment of the invention.

Referring to FIG. 2*a*, a flat spring 201 is attached to the external lower part of the magazine well 214. The flat spring 201 can be attached to the lower portion of magazine well 214 by any art standard technique, such as but not limited to, gluing, welding, bolting, screwing, clipping, or otherwise engaging the end or external periphery of the magazine well.

In the present example, the flat spring 201 is an entire assembly, designed with a bolt-closeable-split, such that the flat spring assembly 201 may surround the base 214 of the magazine well and bolt closed via latch 212 (see FIGS. 2*i*-2*q*, in particular 2*n* and 2*t*). The tension from bolting flat spring 201 closed via latch 212 secures it in place at the base 214 of the firearm's magazine well. Split 213 (FIGS. 2*k*, 2*j*, 2*r*, and 2*s*) can be closed using bolt 202, washer 203, and nut 204 through split 213's spring assembly 201's holes 211.

Figure 2B:
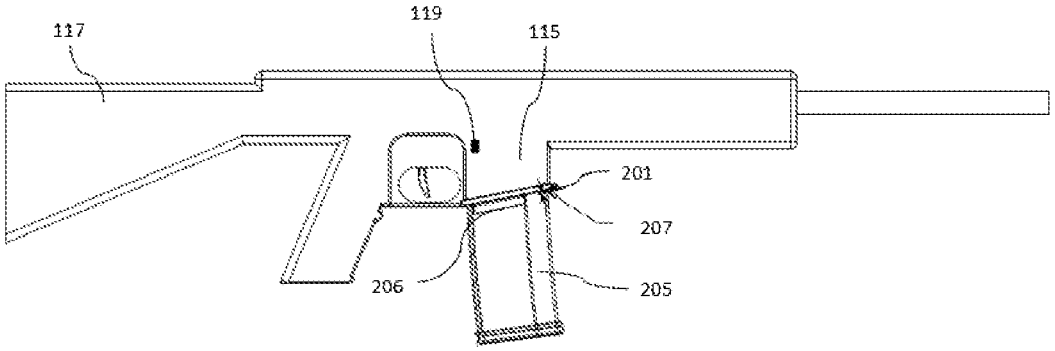
FIG. 2*b* illustrates a right hand side view of the second embodiment anchored to a rifle with the magazine in the loaded position.
Figure 2C:
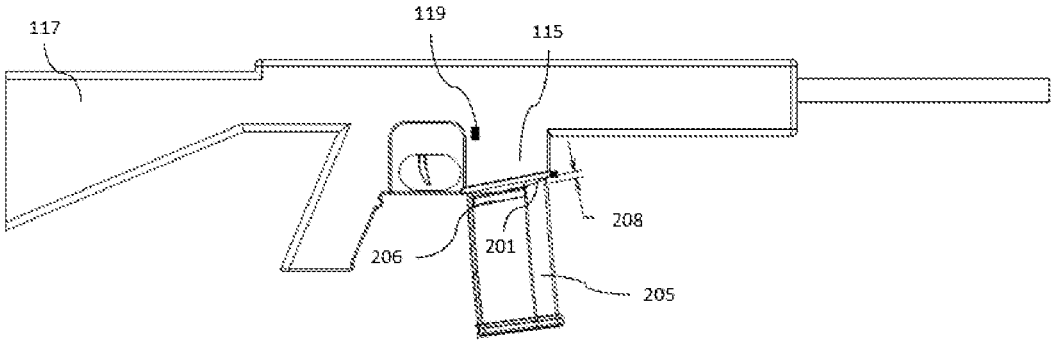
FIG. 2*c* illustrates a right hand side view of the second embodiment anchored to a rifle with the magazine in the ejected (or not loaded) position.
Figure 2H:
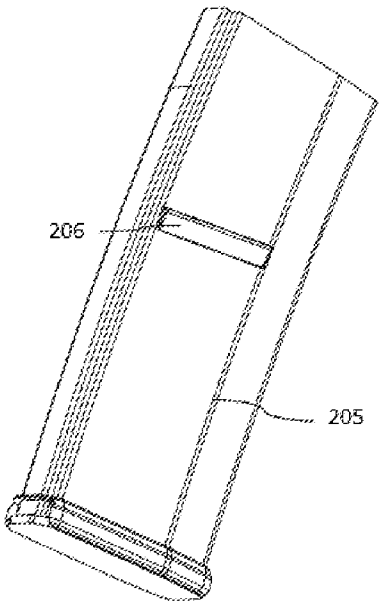
FIG. 2*h* illustrates a front perspective view of a magazine retrofitted with a shelf to support the pressure from the spring on the $2^{nd}$ embodiment of this invention.
Figure 2E:
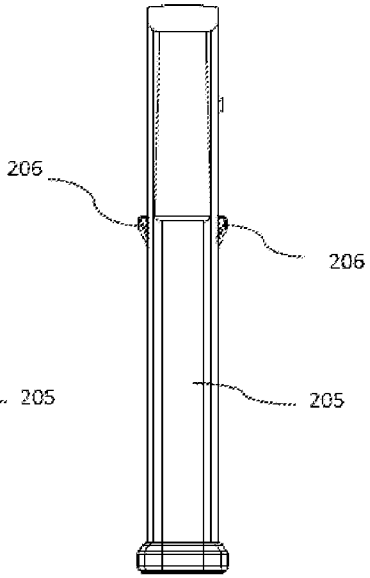
FIG. 2*e* illustrates a front side view of FIG. 2*d*.
Figure 2D:
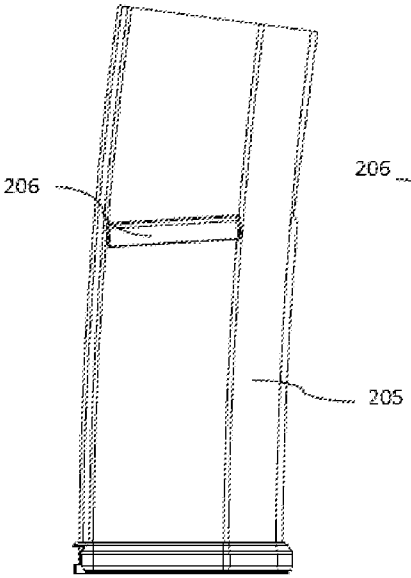
FIG. 2*d* illustrates a right hand side view of a magazine retrofitter with a shelf to support the flat spring pressure from the $2^{nd}$ embodiment of this invention.
Figure 2F:
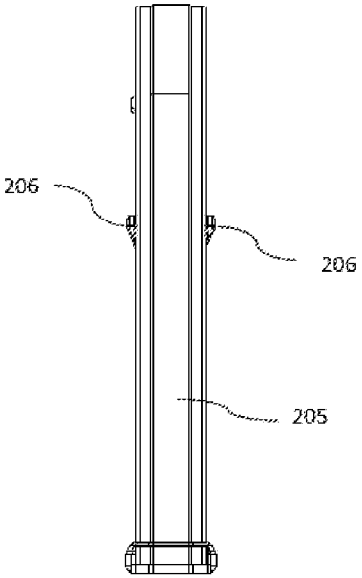
FIG. 2*f* illustrates a back view of FIG. 2*d*.
Figure 2G:
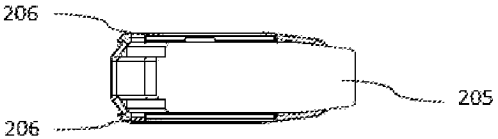
FIG. 2*g* illustrates a top view of FIG. 2*d*.
Figure 2N:
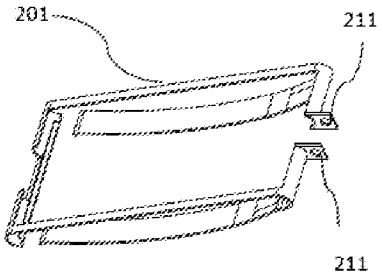
FIG. 2*n* illustrates the bottom perspective view of the $2^{nd}$ embodiment of this invention with the flat spring fully extended.
Figure 2J:
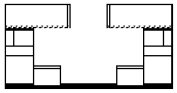
FIG. 2*j* illustrates a front side view of FIG. 2*i*.
Figure 2L:
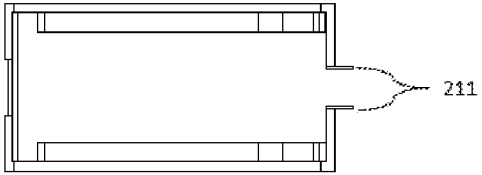
FIG. 2*l* illustrates a top view of FIG. 2*i*.
Figure 2I:
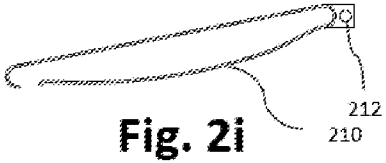
FIG. 2*i* shows a right hand side view of the second embodiment of this invention with the flat spring fully extended.
Figure 2M:
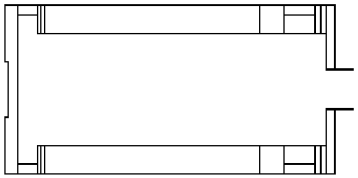
FIG. 2*m* illustrates the bottom view of FIG. 2*i*.
Figure 2K:
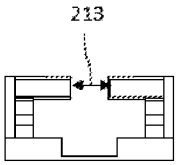
FIG. 2*k* illustrates a back view of FIG. 2*i*.
Figure 2T:
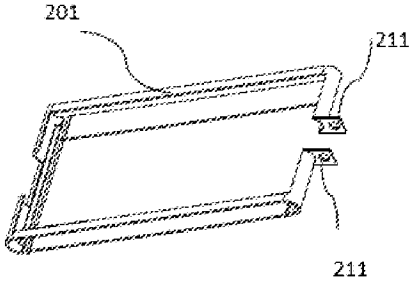
FIG. 2*t* illustrates the bottom perspective view of the $2^{nd}$ embodiment of this invention with the flat spring collapsed.
Figure 2S:
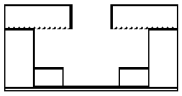
FIG. 2*s* illustrates the bottom view of FIG. 2*o*.
Figure 2P:
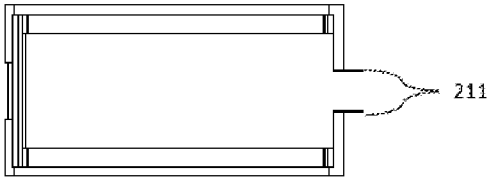
FIG. 2*p* illustrates a front side view of FIG. 2*o*.
Figure 2O:
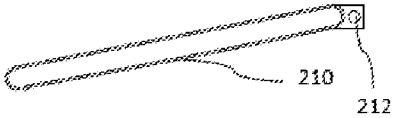
FIG. 2*o* shows a right hand side view of the second embodiment of this invention with the flat spring collapsed.
Figure 2Q:
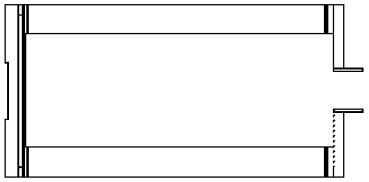
FIG. 2*q* illustrates a back view of FIG. 2*o*.
Figure 2R:
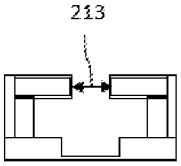
FIG. 2*r* illustrates a top view of FIG. 2*o*.

Referring to FIGS. 2*b* and 2*c*, magazine 205 is inserted into the magazine well. Magazine shelf 206 will make contact with the flat spring 201 upon inserting the magazine, thereby biasing it. When the magazine first contacts the spring upon inserting the magazine, the magazine is at a distance 208 from being completed seated and locked in magazine load position, and the flat spring 201 is fully extended (FIGS. 2*i*-2*n*) with minimum potential energy store. Any further advancement of the magazine 205 into the magazine well 115 will require that the flat spring collapse. The flat spring will continue to collapse until the magazine is seated in the magazine load position. At this point the magazine 205 has travelled into the magazine well a distance equal to the difference between distance 208 (FIG. 2*c*) and fully magazine load distance 207 (FIG. 2*b*). The flat spring curved surface 210 is biased and thus geometrically flat (FIG. 2*o*-2*t*). The distance the curved surface of the flat spring is compressed equals the distance the flat spring is collapsed. In the magazine seated position the magazine is locked in position by the biased magazine release button 119. When the flat spring 210 is fully collapsed under pressure of the magazine shelf 206, the flat spring stores potential energy.

When the magazine release button 119 is pushed the magazine 205 is free to move out of the magazine well, and the flat spring 210 will expand releasing the stored energy as kinetic energy, thereby pushing the magazine 205 out of the magazine well by pushing magazine shelf 206.

The above embodiment is not limited to flat springs. Virtually any art standard mechanism to store potential energy can used, although flat springs are preferred due to their simplicity of manufacture. Indeed, other designs wherein both sides of the flat spring are not backed by a solid wall will give inferior spring constants such that the spring will not serve its intended purpose because its spring constant will be too low.

The invention claimed is:

1. A magazine release assist assembly for a magazine-loading firearm, comprising:

a spring assembly comprising a plurality of springs; and a mechanism to secure the spring assembly to the firearm;

wherein when the spring assembly is installed into a firearm such that when a magazine is loaded into the firearm's magazine well, the plurality of springs bias storing potential energy; and wherein the stored potential energy can be released as kinetic energy to assist in removing the magazine from the firearm.

2. The magazine release assist assembly of claim 1, wherein the plurality of springs are a pair of springs.

3. The magazine release assist assembly of claim 2, wherein the pair of springs are on opposite sides of the assembly, are parallel, and are aligned such that when they are biased, they are always biased in the same direction.

4. The magazine release assist assembly of claim 1, wherein the plurality of springs are at regular intervals around the spring assembly to prevent torqueing of the magazine and sticking of the magazine when releasing the magazine.

5. The magazine release assist assembly of claim 1, wherein the plurality of springs are helical springs.

6. The magazine release assist assembly of claim 1, wherein the plurality of springs are flat springs.

7. The magazine release assist assembly of claim 1, wherein when the magazine is ejected from the firearm, the spring assembly remains secured to the firearm.

8. A method of releasing a magazine from a firearm, comprising:

securing a spring assembly comprising a plurality of springs to a firearm such that when a magazine is inserted into the firearm, the at least one spring is biased to store potential energy; and ejecting the magazine from the firearm wherein the spring converts the stored potential energy into kinetic energy that assists the ejection.

9. The method of claim 8, wherein the plurality of springs is a pair of springs.

10. The method of claim 9, wherein the pair of springs are on opposite sides of the assembly, are parallel, and are aligned such that when they are biased, they are always biased in the same direction.

11. The method of claim 8, wherein the plurality of springs are at regular intervals around the spring assembly to prevent torqueing of the magazine and sticking of the magazine when releasing the magazine.

12. The method of claim 8, wherein the plurality of springs are helical springs.

13. The method of claim 8, wherein the plurality of springs are flat springs,is a flat spring.

14. A method of manufacturing a spring assembly to assist ejecting a magazine from a firearm, comprising:

machining a spring assembly comprising a plurality of springs; and securing the spring assembly to the firearm, such that when a magazine is inserted into the firearm, the plurality of springs will store potential energy to assist ejecting the firearm.

15. The method of claim 14, further comprising:

a mechanism to secure the spring assembly the firearm, which is adapted to surround the base of the firearm's magazine well and tighten, such that the mechanism surrounds and is secured to the base of the firearm's magazine well.

16. A spring assembly to assist releasing a magazine from a firearm, comprising:

a rectangular body, wherein the rectangular body comprises two parallel flat springs;

wherein the rectangular body is adapted to be secured to the base of a magazine well of a firearm;

wherein one end of each of the two flat springs is secured to the rectangular body, and the other end of each of the two flat springs is not secured to the rectangular body; and wherein the spring assembly is designed such that when the spring assembly is installed on a firearm, the end of each of the two flat springs that is not secured to the rectangular body is adapted to slide against the edge of the firearm's magazine well.

17. The spring assembly of claim 16, wherein the two flat springs are on substantially opposite sides of the rectangular body, and face substantially the same direction.

18. A spring assembly to assist releasing a magazine from an integrated firearm, comprising:

a firearm comprising a magazine well;

two rods integrated with the firearm, installed parallel to the direction magazines are inserted and removed to the magazine well;

one sliding member installed on each of the two rods, such that the sliding members can slide up and down the rods; and one helical spring installed on each of the two rods, such that the springs extend push the sliding members to one side of the rods but can be compressed so the sliding members travel down the rod;

wherein when a magazine is loaded into the firearm, the magazine catches the sliding members, slide the sliding members up the two rods, and compress the helical springs, such that when the magazine is fully loaded and locked into the firearm, the helical springs are compressed; and wherein when the magazine is ejected from the firearm, the compressed helical springs release stored energy and assist the magazine in ejection.

* * * * *